US005459990A

United States Patent [19]

Tsuzuki

[11] Patent Number: 5,459,990

[45] Date of Patent: Oct. 24, 1995

[54] FACILITY AND METHOD FOR PRODUCING YARN

[75] Inventor: Kiyohiro Tsuzuki, Greenville, S.C.

[73] Assignee: TNS Mills, Inc., Greenville, S.C.

[21] Appl. No.: 136,320

[22] Filed: Oct. 14, 1993

[51] Int. Cl.[6] ..... D01G 21/00; D01H 4/50

[52] U.S. Cl. ..... 57/281; 19/98; 19/99; 19/145.5; 19/145.7; 19/200; 57/1 R; 57/266; 57/362; 198/399; 198/400

[58] Field of Search ..... 19/200, 98, 99, 19/163, 145.5, 145.7, 65 A; 198/399, 400, 406; 57/308, 281, 266, 362, 1 R

[56] References Cited

U.S. PATENT DOCUMENTS 317,675 5/1885 Russell .
1,629,167 5/1927 Krantz .

(List continued on next page.)

FOREIGN PATENT DOCUMENTS 2201013 7/1973 Germany ..... 198/400
550017 5/1977 Germany .

OTHER PUBLICATIONS

Three Dimensional Bale Opening System ROTOMIX 3D Model Rmx 6.046; Hollingsworth (No date available).
Blending Installation Laydown Cross Blender Model LCB 6.108, Hollingsworth (No date available).
Blending Installation Laydown Cross Blender Model LCB II 6.108 Hollingsworth (No date available).
Automatic Card Feeding System MASTERCHUTE Model Mc–WL 6.138; Hollingsworth (No date available).
Machines For Opening And Blending Of Short Staple Fibers; Hollingsworth (No date available).
Model 2000 MASTERCOILER; Hollingsworth (No date available).
Model 200 Card; Hollingsworth (No date available).
Automatic Card Feeding System MASTERCHUTE 6.130, Hollingsworth (No date available).
AFS Air Fiber Separator, Hollingsworth (No date available).
Automatic Card Feeding System MASTERCHUTE MC–N 6.130, Hollingsworth (No date available).
Automatic Card Feeding System MASTERCHUTE MC–W 6.130 Hollingsworth (No date available).
Type 2000 Card, Hollingsworth (No date available).
Air Fibre Separator Model AFS/AFS–T 1500, 6.180, Hollingsworth (No date available).
Dosage and Storage Installations Model FS 6.200/RS 6.210; Hollingsworth (No date available).
MASTERCLEAN Model MAC III 6.072; Hollingsworth (No date available).
Type 789 MASTERLEVELER Card Autoleveller; Hollingsworth (No date available).
Roller Cleaner Model WR–WR/Z 6.102; Hollingsworth (No date available).

*Primary Examiner*—Daniel P. Stodola
*Assistant Examiner*—William Stryjewski
*Attorney, Agent, or Firm*—Hardaway Law Firm

[57] ABSTRACT

A high efficiency facility for producing yarn is provided wherein fibers pass through machines in the following order: a mixing mechanism (1), a first pair of cleaners (5, 7), a laydown cross blender (11), a second pair of cleaners (15, 17), an air fiber separator (23), a pair of vertical mixers (26, 28), a pair of air fiber separators (33, 35), and a pair of multiple chute feeders (41, 43). A plurality of carding machines (61) receive the fibers from the feeders (41, 43) and produce carded sliver from the fibers. A coiling apparatus (63) receives the carded sliver from each of the carding machines (61) and coils it into a plurality of carding containers, from which a drawing frame (71) feeds the carded sliver into a plurality of drawing containers. A plurality of open-end spinning machines (81) spin the carded sliver into yarn packages. The facility may further include a package transporting system (101) for transporting packages from the spinning machines (81) to a conveyor (104) such that the packages are deposited onto the conveyor (104) at a predetermined distance from one another without contacting each other.

28 Claims, 9 Drawing Sheets

U.S. PATENT DOCUMENTS

| | | | |
|---|---|---|---|
| 2,127,638 | 8/1938 | Brandwood . | |
| 3,070,948 | 1/1963 | Tsuzuki | 57/36 |
| 3,191,375 | 6/1965 | Naegeli . | |
| 3,328,948 | 7/1967 | Du Buis et al. | 198/400 X |
| 3,469,385 | 9/1969 | Tsuzuki | 57/34 |
| 3,564,829 | 2/1971 | Tsuzuki | 57/36 |
| 3,650,104 | 3/1972 | Shepherd et al. | 57/58.91 |
| 3,710,924 | 1/1973 | Schultz | 198/400 X |
| 3,787,615 | 1/1974 | Foerster et al. | 178/6.6 P |
| 3,816,991 | 6/1974 | Takeuchi et al. | 57/36 |
| 3,828,921 | 8/1974 | Tackett | 198/400 X |
| 4,022,007 | 5/1977 | Motobayashi et al. | 57/58.95 |
| 4,031,709 | 6/1977 | Blankemeyer | 198/399 X |
| 4,098,065 | 7/1978 | Stahlecker et al. | 57/58.95 |
| 4,150,530 | 4/1979 | Derichs | 57/263 |
| 4,497,168 | 2/1985 | Kamp | 57/401 |
| 4,565,278 | 1/1986 | Asai et al. | 198/400 |
| 4,590,683 | 5/1986 | Magin | 34/1 |
| 4,590,757 | 5/1986 | Stahlecker | 57/412 |
| 4,607,485 | 8/1986 | Stahlecker | 57/401 |
| 4,697,692 | 10/1987 | Kupper et al. | 57/281 X |
| 4,703,618 | 11/1987 | Dinkelmann | 57/281 |
| 4,730,450 | 3/1988 | Tone | 57/281 |
| 4,864,693 | 9/1989 | Pinto et al. | 19/300 |
| 4,922,707 | 5/1990 | Meroni et al. | 57/408 |
| 4,932,201 | 6/1990 | Meroni et al. | 57/279 |
| 4,939,895 | 7/1990 | Raasch et al. | 57/263 |
| 4,974,718 | 12/1990 | Raasch et al. | 198/399 X |
| 5,007,136 | 4/1991 | Artzt et al. | 19/65 A |
| 5,038,438 | 8/1991 | Gunter | 19/65 A |
| 5,064,049 | 11/1991 | Saito | 198/399 |
| 5,157,910 | 10/1992 | Artzt et al. | 57/308 |
| 5,253,392 | 10/1993 | Ripley | 19/65 A X |
| 5,321,942 | 6/1994 | Hartness | 57/308 X |
| 5,333,440 | 8/1994 | Tsuzuki | 57/90 |

FACILITY AND METHOD FOR PRODUCING YARN

BACKGROUND OF THE INVENTION

This invention relates to a layout for a facility which is to produce finished yarn at a high efficiency.

Various plant layouts have existed for the production of textile yarns for ultimately weaving or knitting into desired fabric. It has been known to automate one or more stages of fiber preparation, sliver production and storage, and/or spinning of carded sliver into finished yarn. Nevertheless, such layouts invariably still involve manual intervention in several other yarn production stages. As is known, manual labor in these stages can often be costly and inefficient in terms of processing times.

While plants have effectively operated utilizing the arrangement as above described, room exists for improvement in overall plant operations.

SUMMARY OF THE INVENTION

It is an important object of the present invention to provide a high efficiency production facility which substantially eliminates the need for manual intervention in the production of yarn.

It is a further object of the present invention to provide a high efficiency production facility which is capable of producing large volumes of finished yarn with a minimum number of manual operators.

These as well as other objects are accomplished by a high efficiency yarn production facility wherein fibers sequentially pass through a mixing mechanism, a first pair of cleaners, a laydown cross blender, a second pair of cleaners, an air fiber separator, a pair of vertical mixers, a pair of air fiber separators, and a pair of multiple chute feeders. A plurality of carding machines receive the fibers from the feeders and produce carded sliver from the fibers. Coiling means receives the carded sliver from each of the carding machines and coils it into a plurality of carding containers, from which a feeding means feeds the carded sliver into a plurality of drawing containers. A plurality of open-end spinning machines spin the carded sliver into yarn packages. A package transporting system may then transport the packages from the spinning machines to a conveyor such that the packages are deposited onto the conveyor at a predetermined distance from one another without making contact.

Thus, with the exceptions of initially providing bales and threading sliver ends into the open-end spinning machines, every stage in the production of yarn in the facility of the present invention is automated.

DETAILED DESCRIPTION

In accordance with this invention it has been found that a high volume yarn production process may be carried out utilizing mechanized equipment in such a manner as to almost totally eliminate the need for multiple workers within a large yarn producing operation. Various other advantages and features will become apparent from the following description given with reference to the figures of drawing.

Figure 1:
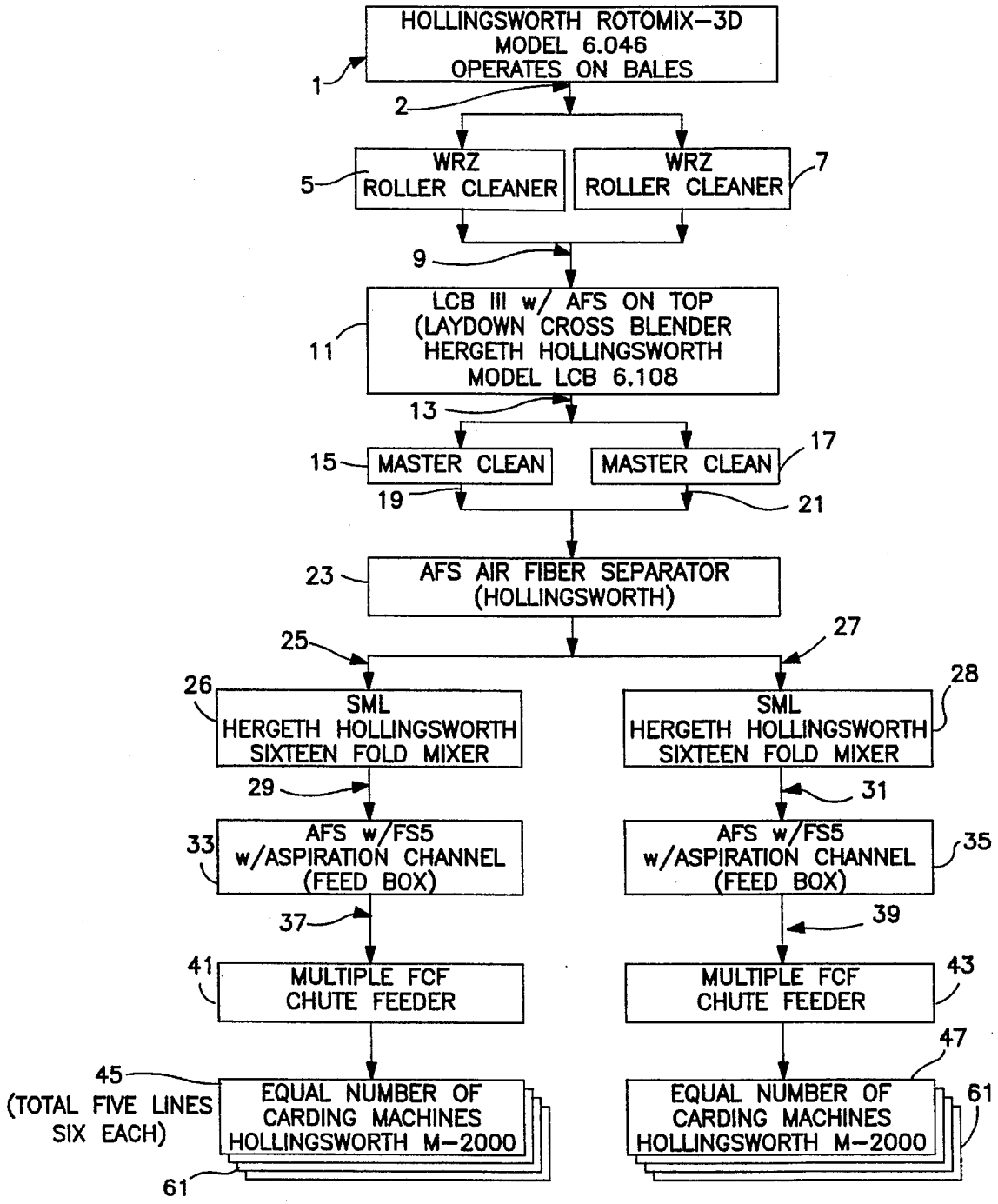
FIG. 1 is a schematic diagram of a portion of the sequence of stations utilized in the production of yarn in a facility constructed in accordance with a preferred embodiment of the present invention.

FIG. 1 of the drawings represents in schematic fashion the operation of a fiber processing plant for the production of yarn, preferably cotton yarn, and thus the following description will be given with reference to production of cotton yarn packages.

Within the schematic diagram, cotton bales are operated upon by a bale handling mechanism 1 which is preferably a HOLLINGSWORTH automated ROTOMIX-3D Model RMX 6.046. As is described in the literature, such an apparatus takes cuts from a plurality of cotton bales at various angles to provide a mix of cotton fibers from a variety of locations within the bales. The apparatus mixes such fibers and transports them to a transport fan such as a HOLLINGSWORTH TV 350 illustrated at 2 where the cotton fibers are then fed in parallel to cleaners 5 and 7. Such cleaners are preferably the WRZ-type roller cleaners also by HOLLINGSWORTH. The total output of both cleaners 5 and 7 is then recombined. The use of two cleaners has been found to promote further random mixing of the fibers. Such fibers are then transported via transport fan 9 similar to the previously described fan 2 to a laydown cross blender illustrated at 11 as LCB III, preferably a HERGETH HOLLINGSWORTH Model LCB 6.108. Such laydown cross blenders as described in the literature further promote randomness of the fibers and thus a uniformity from section to section. Preferably the LCB illustrated at 11 has an air fiber separator (AFS) on the top thereof to further enhance mixing. As there are several AFS apparatuses used in the fiber treatment process of this invention, the preferred AFS is of the type provided by HERGETH HOLLINGSWORTH.

The output of the AFS illustrated in box 11 is then transported via a transport fan 13 to a pair of cleaners 15 and 17 preferably of the type sold by HOLLINGSWORTH under the trademark MASTER CLEAN. Each cleaning device 15 and 17 has its own transport fan 19 and 21 respectively at the exit thereof where the fibers are recombined for a feeding to a second air fiber separator 23.

The output of air fiber separator 23 is split and transported via two transport fans 25 and 27, preferably to two vertical mixers 26 and 28 with six compartments each, utilized to further mix and randomize the fibers. Such mixer device is preferably a HERGETH HOLLINGSWORTH SML mixer with six compartments. Such a mixer is continuously operated and is fed via air transport to the transport fans 25 and 27. The output of each SML is then fed via transport fans 29 and 31 to additional air fiber separators 33 and 35. These air fiber separators additionally however have feed boxes with aspiration channels associated therewith such as those sold by HOLLINGSWORTH from the designation FS5 feed boxes. The output of each of these units 33 and 35 is transported via transport fans 37 and 39, respectively, to multiple chute feeders designated by 41 and 43 with each chute feeder feeding a separate carding machine indicated here as 45 and 47. Carding machines 45 and 47 are indicated as each being a plurality of carding machines 61, preferably five lines of carding machines with six carding machines 61 in each line. Preferably, carding machines 45 AND 47 are HOLLINGSWORTH M 2000 carding machines. As is well known, such an apparatus produces a carded sliver for further treatment toward the production of yarn.

Figure 2:
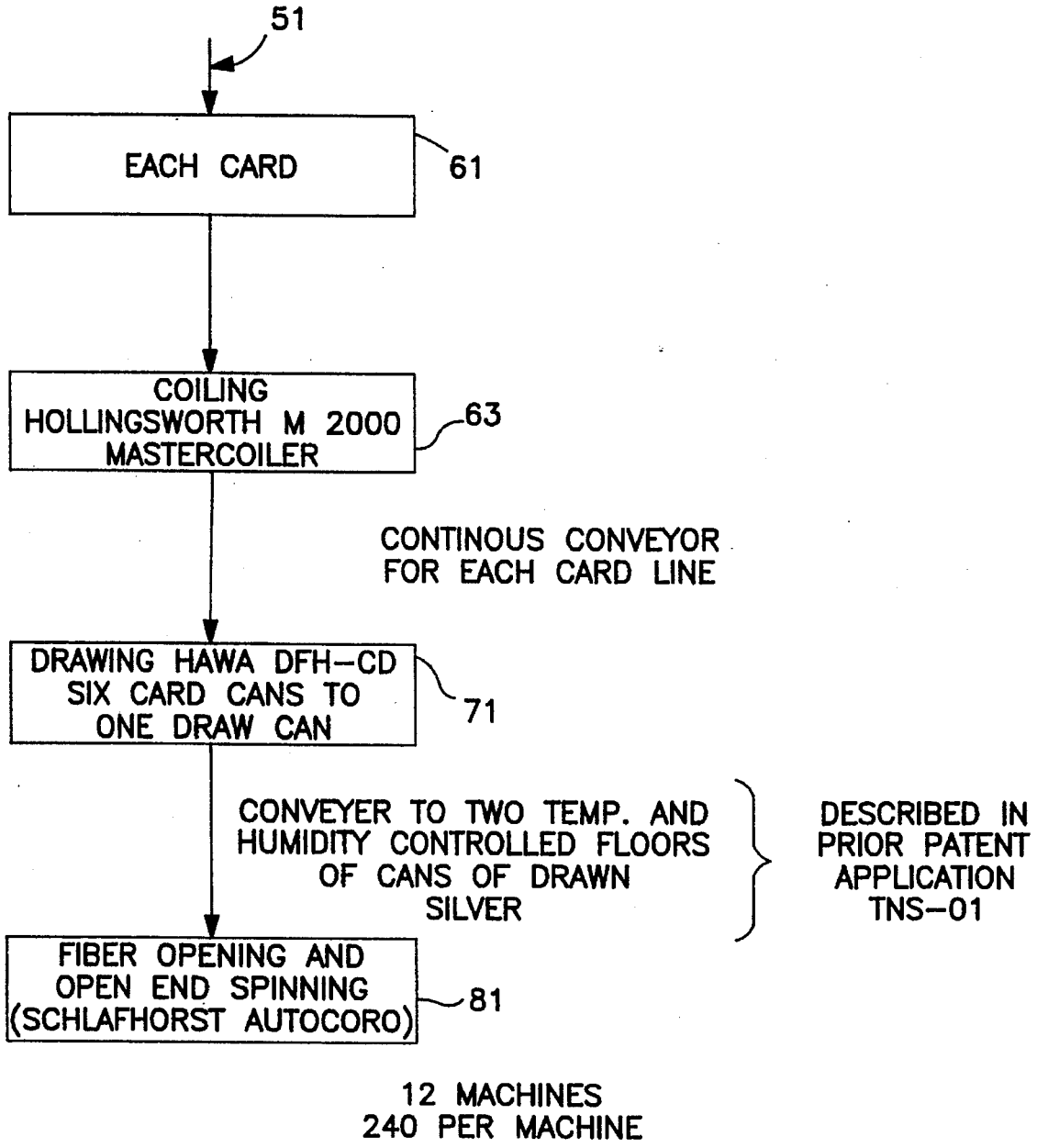
FIG. 2 is a schematic diagram of the remaining portion of the sequence of stations utilized in the production of yarn in a facility constructed in accordance with the preferred embodiment of the present invention.

Referring to FIG. 2 of the drawings, the designation 51 is referring to the output of a single carding machine such as that designated at plural carding machines with regard to 45 and 47. The carded sliver from each carding machine 61 is then fed to a coiling apparatus illustrated at 63 which coils sliver into a carding container or can. Preferably a HOLLINGSWORTH M 2000 MASTERCOILER™ is used for this purpose. The carding cans are then fed onto conveyors having robots associated therewith such as those used in automatic splicing equipment and automatic can rotating systems, where the cans are transported to a drawing frame illustrated at 71. Preferably a state of the art drawing frame such as a HOWA DFH-CD is utilized. At this high tech drawing frame, six card cans are utilized for drawing to be fed into one drawn sliver can for further utilization. Following the filling of a drawn sliver can, such cans are conveyed via conveyors to two staging areas with controlled temperature and humidity. Such staging areas are described in U.S. Pat. No. 5,333,440 the disclosure of which is hereby incorporated by reference.

As described in U.S. Pat. No. 5,333,440, the drawn sliver is fed into vertical tubes on two floors for feeding to a plurality of fiber opening and open-end spinning devices 81. Preferably, open end spinning devices 81 are SCHLAFHORST AUTOCORO™ spinning machines. Utilizing the arrangement just described with regard to the preferred embodiment, up to three thousand drawn sliver containers would be located equally distributed between two floors for feeding into such an AUTOCORO™ device which produces a final yarn package ready for post yarn treatment.

Such post yarn treatment may include means for transporting yarn packages from the spinning machines to a conveyor, such means being illustrated in FIGS. 3–14, which show a package transport system 101 communicating with a textile machine 102, preferably an open-end spinning machine, and with a transport conveyor 104. The system 101 deposits yarn packages onto the transport conveyor 104 at a predetermined distance from one another, such that the yarn packages do not contact each other during any point as they are transferred to and from the system 101.

Figure 3:
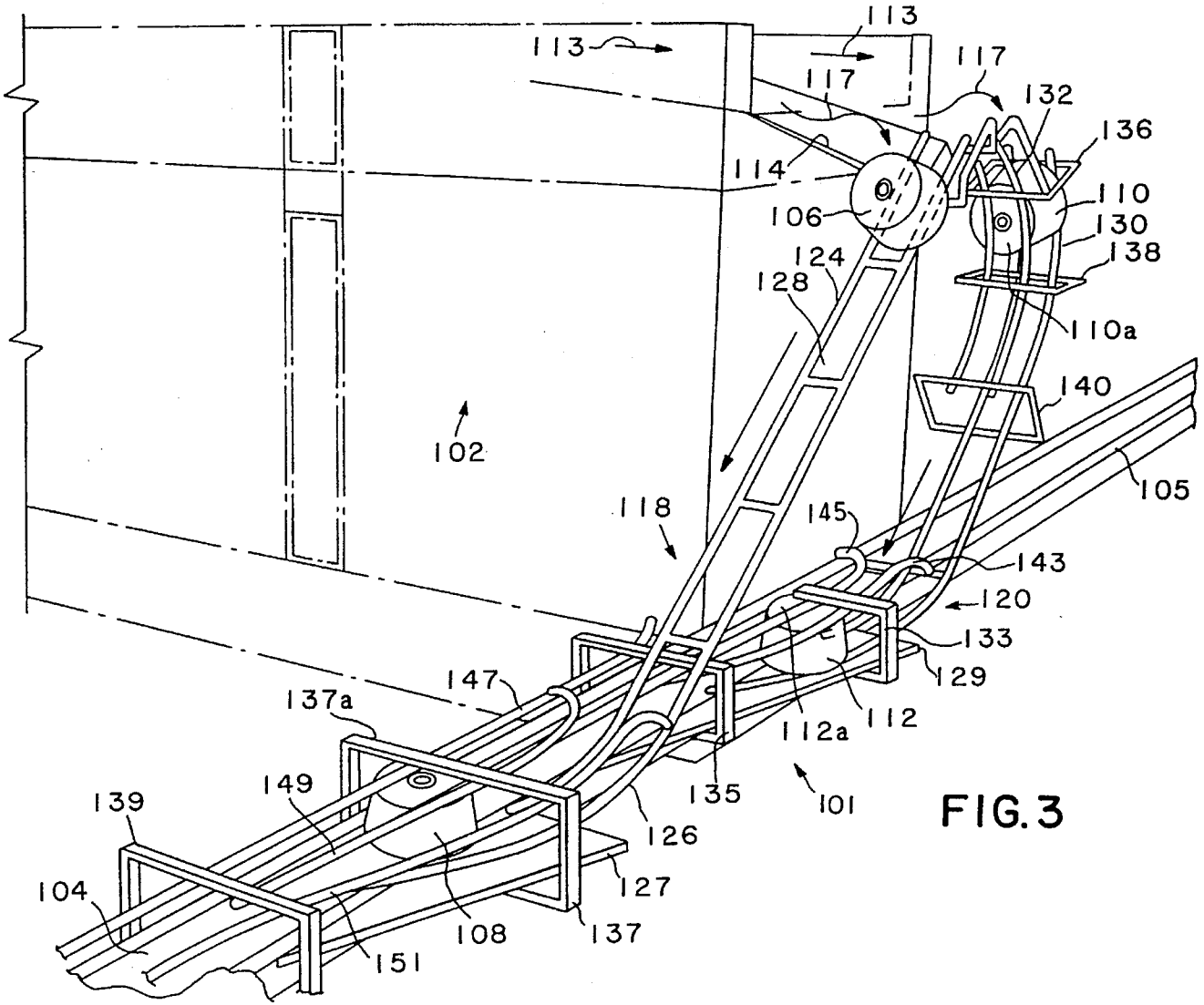
FIG. 3 is a perspective view of the operation of a package transport system used in the production facility constructed in accordance with the preferred embodiment of the present invention.
Figure 4:
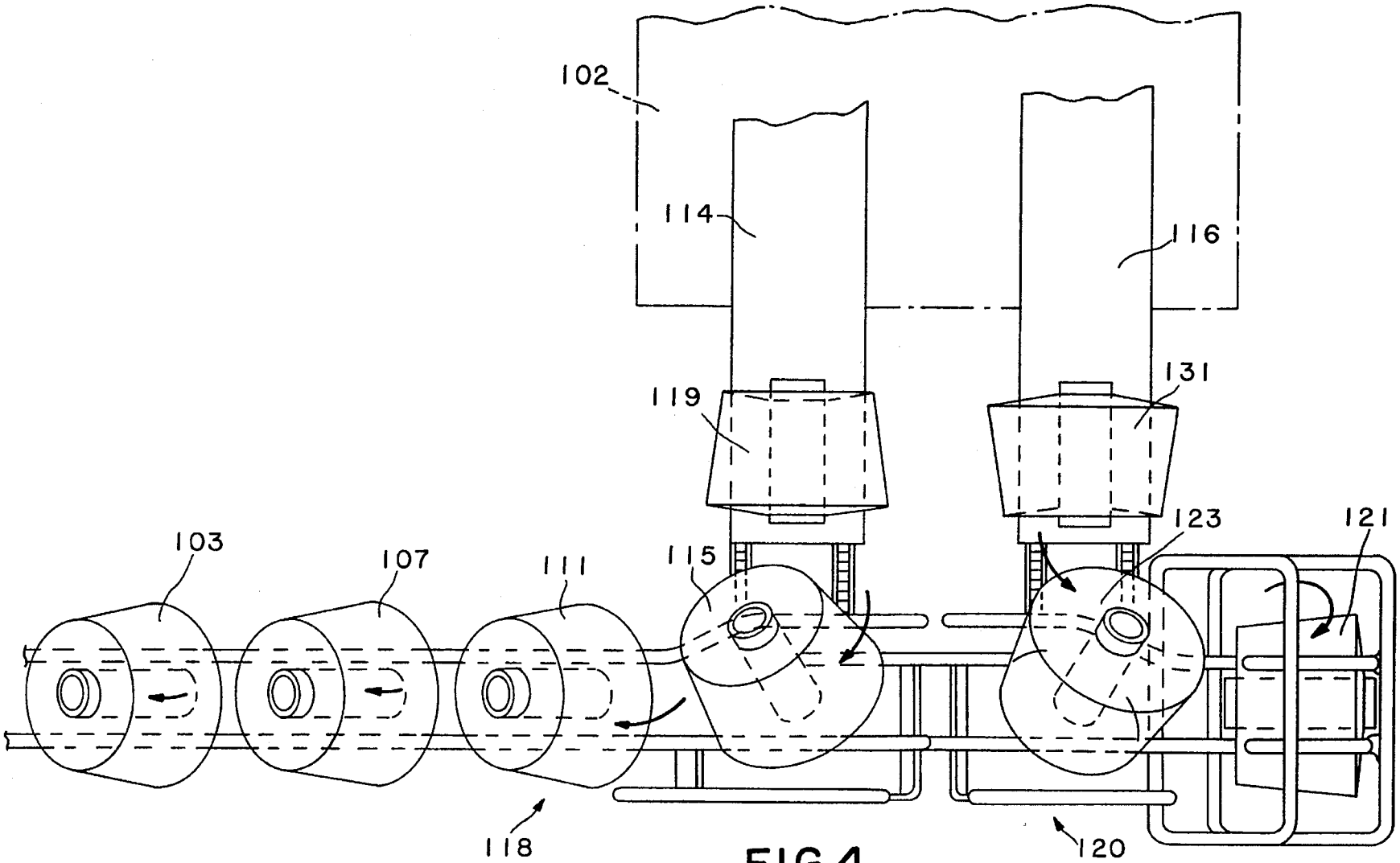
FIG. 4 is a plan view of the package transport system illustrated in FIG. 3, showing packages traveling down output conveyors of a spinning machine and showing additional packages traveling down first and second chutes of the system.

Referring to FIG. 3, a conventional open-end spinning machine 102 spins carded sliver into finished yarn packages 106, 108, 110, and 112, whereupon they are conveyed from a top portion of machine 102 in the direction of arrows 113 via first and second output conveyors 114 and 116, respectively (see FIG. 4). Upon reaching the end of the output conveyors 114 and 116, the packages are transferred to the transport system 101, as shown by arrows 117, whereupon they fall by gravity through first and second chutes 118 and 120, respectively, onto the transport conveyor 104 such that no two packages contact one another from the time of their production to the time they are deposited on the transport conveyor 104.

The first chute 118 communicates with the first output conveyor 114 and is attached thereto preferably with fastening means such as a mounting bracket 122 (FIG. 9) and one or more threaded fasteners (not shown). The first chute 118 is preferably configured as a rail, comprised of a pair of shaped longitudinal members 124, 126 joined by a plurality of transverse members such as at 128. A first wedge-shaped mounting plate 127 interconnects the lower ends of the members 124 and 126 to a frame 105 of the transport conveyor 104.

The second chute 120 communicates with the second output conveyor 116; however, unlike first chute 118, second chute 120 is comprised of a pair of rails 130 and 132 for a predetermined length. These rails confine the top and bottom faces of a package such as at 110, ensuring that it descends along the path defined by the rails. When package 110 is first placed onto the second chute 120, it rests upon rail 132; however, its weight is transferred to rail 130 at a point along its path of travel. Consequently, once it is deposited onto the transport conveyor 104, face **110*a* of package 110 points upwardly in the same manner as face 112*a* of package 112. Due to this upturning of faces, positions of packages traveling down the second output conveyor 116 are rotated 180° from those of packages traveling down the first output conveyor 114 (see FIG. 4, packages 119 & 131) so that all transported packages have the same orientation on the transport conveyor 104**, i.e., their lower faces have a greater diameter than the faces pointing upwardly.

Figures 9, 10:
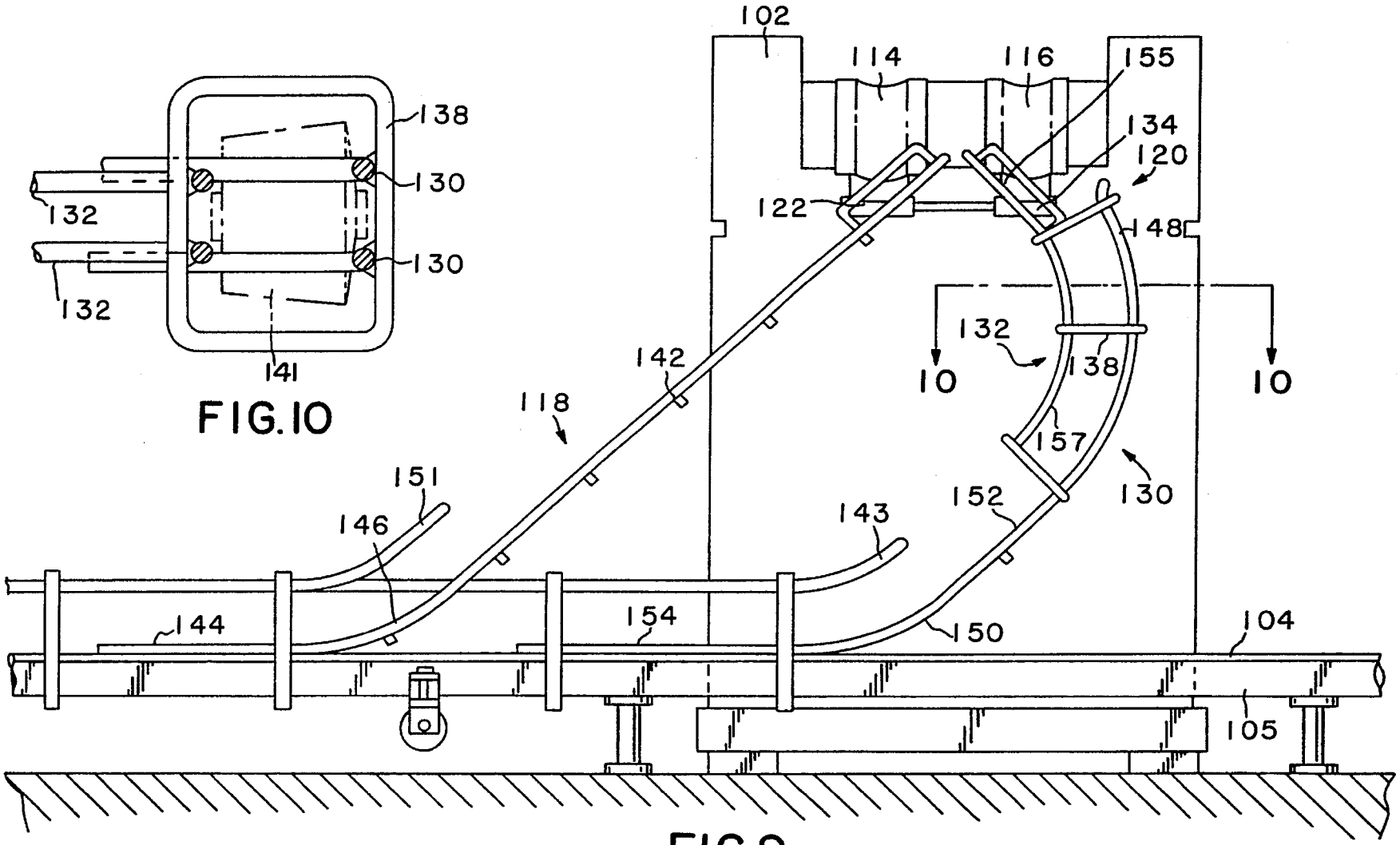
FIG. 9 is a side elevation view of a package transport system constructed in accordance with the preferred embodiment of the present invention, illustrating the profiles of the chutes in their entirety.
FIG. 10 is a sectional elevation view of a chute taken along line 10—10 in FIG. 9, showing a yarn package in phantom lines seated therein.

Rail 132 is attached to the second output conveyor 116 in the same manner as is first chute 118 to the first output conveyor 114; i.e., preferably with a mounting bracket 134 (FIG. 9). As with the lower end of the first chute 118, the lower ends of second chute 120, or more particularly the rail 130, are interconnected to the transport conveyor frame 105 through a second wedge-shaped mounting plate 129.

Rails 130 and 132, as well as the rail comprising the first chute 118, are preferably constructed of stainless steel tubing. Rail 132, spaced equidistantly from rail 130 along its entire length, is interconnected to rail 130 by way of a plurality of retaining rings 136, 138, and 140 which are preferably attached to rails 130 and 132 by welds, although other fastening means are contemplated as being within the scope of the present invention.

The ring-rail connection in the preferred embodiment is best seen in FIG. 10. A package traveling down second chute 120 is shown in phantom lines at 141.

FIG. 3 additionally shows a means for retaining packages 108 and 112 on the transport conveyor 104 once they leave first chute 118 and second chute 120, respectively. In the preferred embodiment, this means is a retaining rail assembly elevated above transport conveyor 104. This retaining rail assembly includes a first bracket 133 mounted to frame 105 proximate a terminus of second chute 120, a second bracket 135 mounted to frame 105 and longitudinally spaced from first bracket 133, a third bracket 137 mounted to frame 105 and longitudinally spaced from second bracket 135, and a fourth bracket 139 mounted to frame 105 and longitudinally spaced from third bracket 137. Each of these brackets are preferably oriented transversely to the transport conveyor 104. A first retaining extension 143 originates proximate first bracket 133 and terminates at fourth bracket 139; a second retaining extension 145 originates proximate first bracket 133 and terminates at second bracket 135; a third retaining extension 147 originates proximate second bracket 135 and extends beyond fourth bracket 139; a fourth retaining extension 149 originates proximate third bracket 137 and terminates at fourth bracket 139, and a fifth retaining extension 151 originates proximate third bracket 137 and extends beyond fourth bracket 139. Retaining extensions 143, 145, 147, 149, and 151 are preferably constructed of tubular members of the type used in longitudinal members 126 and 128 of first chute 118. Each of these extensions are connected to an interior face of an upper leg, such as at 137a, of associated brackets.

While the aforementioned structure for retaining packages 108 and 112 on the transport conveyor 104 is the preferred means, equivalent structures are contemplated as being within the scope of the present invention. For instance, instead of supporting tubular members, brackets mounted to frame 5 may support flat plates to retain packages on the transport conveyor 4.

Referring to FIGS. 4–8, packages 103, 107, 111, 115, and 119 are shown descending down first output conveyor 114 and first chute 118, while packages 121, 123, and 131 are shown descending down second output conveyor 116 and second chute 120. Package 115, shown in transition between the first output conveyor 114 and the first chute 118, assumes an intermediate position whereby it is rotating away from the spinning machine 102 about the point where the package 115 contacts member 124 of first chute 118 (see FIG. 7). Package 123 likewise undergoes such motion with respect to member 180 of second chute 120 (see FIG. 8). Once packages on the first chute complete the aforementioned transition, they assume the position shown at FIG. 6, where a central longitudinal axis 107*a* of a package 107 is normal to a plane P containing members 124 and 126.

FIG. 9 illustrates the profile of the package transport system 101. Although the rails comprising the chutes 118, 120 are preferably unitary, the profile of each of them includes several distinct geometric portions. Specifically, the profile of first chute 118 is defined by a first straight portion 142 inclined at an angle with respect to the transport conveyor 104, a second straight portion 144 substantially parallel to the transport conveyor 104, and an arcuate portion 146 joining portions 142 and 144. The profile of the rail 130 of second chute 120 is defined by a first arcuate portion 148, a second arcuate portion 150, a first straight portion 152 joining portions 148 and 150 and inclined at an angle with respect to the transport conveyor 104, and a second straight portion 154 extending from the second arcuate portion 150 in substantially parallel relation to the transport conveyor 104. The profile of rail 132 of second chute 120 is defined by a straight portion 155, which is inclined at angle to the transport conveyor 104 and which is approximately 90° to the first straight portion 142 of first chute 118, and an arcuate portion 157.

The following dimensions of each portion of first chute 118 and of second chute 120 (rails 130 and 132) have been found to provide optimum uniformity in package transport:

| Portion | Parameter | Dimension |
|---|---|---|
| First chute 118 | | |
| first straight portion 142 | length | 1636 in. |
| second straight portion 144 | length | 630 in. |
| arcuate portion 146 | radius | 600 in. |
| | subtending angle | 45° |
| Rail 130 | | |
| first arcuate portion 148 | radius | 450 in. |
| | subtending angle | 90° |
| second arcuate portion 150 | radius | 600 in. |
| | subtending angle | 45° |
| first straight portion 152 | length | 364 in. |
| second straight portion 154 | length | 630 in. |
| Rail 132 | | |
| straight portion 155 | length | 220.5 in. |
| arcuate portion 157 | radius | 600 in. |
| | subtending angle | 45° |

Figure 12:
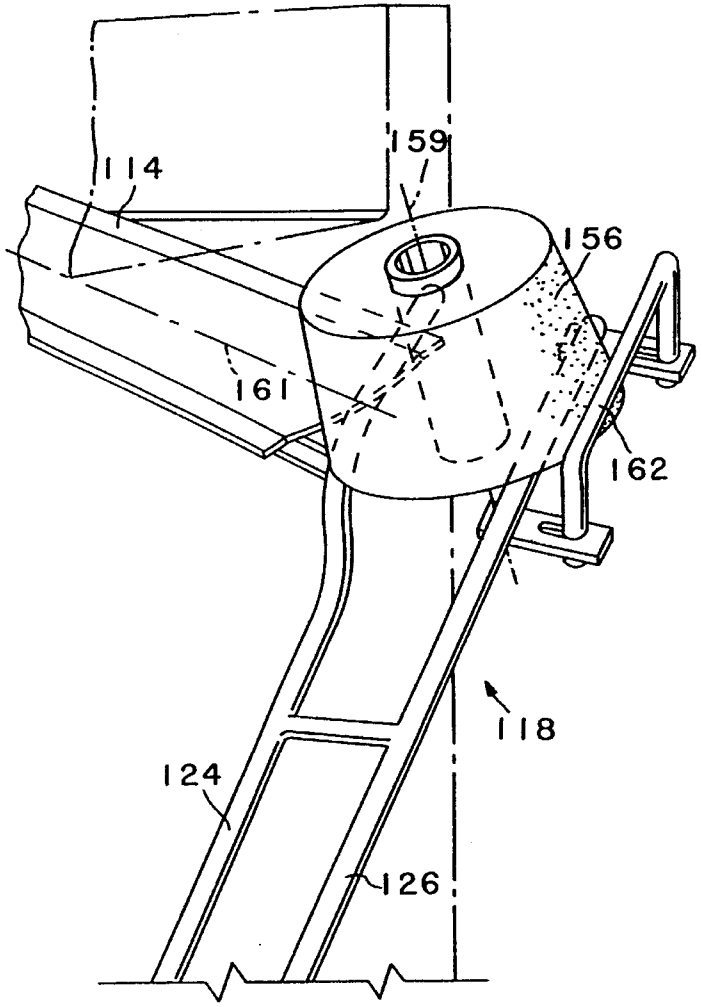
FIG. 12 is a perspective view similar to FIG. 11, except that it shows the package illustrated therein as having just been placed on the first chute of the package transport system.
Figure 11:
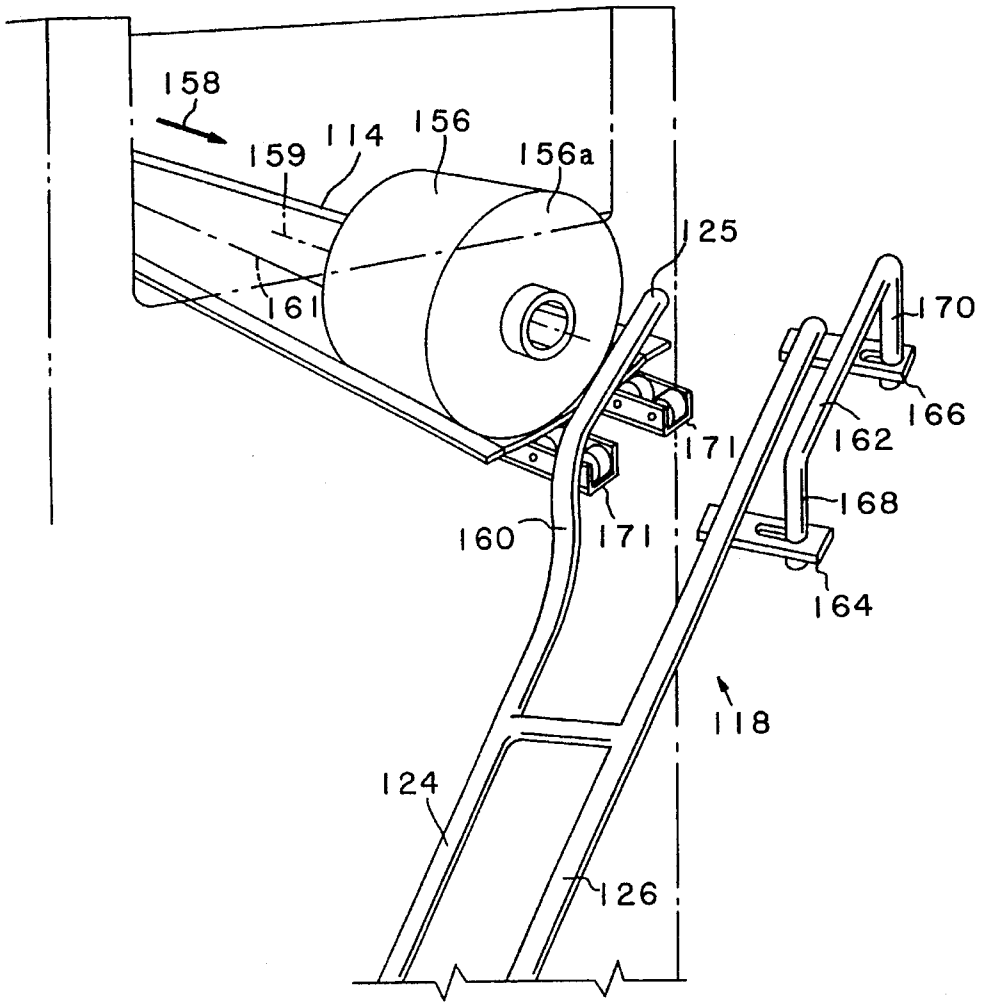
FIG. 11 is a perspective view of a yarn package moving off a first output conveyor of a spinning machine just before it reaches a first chute of the package transport system.

FIGS. 11 and 12 illustrate the cause of the change in orientation a yarn package undergoes in moving from the first output conveyor 114 onto the first chute 118.

In FIG. 11, a first package 156 having a central longitudinal axis 159 moves toward the end of the first output conveyor 114 in the direction shown by arrow 158. During this motion, axis 159 is substantially parallel to a longitudinal axis 161 of the first output conveyor 114. As front face 156*a* of package 156 passes the end of the first output conveyor 114, the package 156 travels over a pair of roller assemblies 171 hingedly mounted to the front output conveyor 114. Travel of the package 156 in the direction of arrow 158 halts when front face 156*a* contacts member 124 of chute 118 at a terminal portion 125 of the member 124, which may be flared outwardly from the remainder of member 124 through a flared portion 160. As shown in FIG. 11, a retaining bar 162 is mounted alongside member 126 of first chute 118 to ensure that the package 156 does not fall from the first chute 118 upon transfer thereto. Mounting means for the retaining bar 162 comprises transverse plates 164, 166 welded to member 126 and accommodating lower ends of vertical sections 168, 170 of retaining bar 162 in slots 163, 165 formed within the plates 164, 166, respectively. This slotted attachment permits either or both ends of the retaining bar 162 to be moved toward or away from member 126, depending upon the size or configuration of the yarn package leaving the first output conveyor 114.

Referring to FIG. 12, first package 156 has undergone a change in its orientation upon having been transferred to first chute 118. Axis 159 is now substantially perpendicular to the first straight portion 142 (FIG. 9) of first chute 118. Thus, package 156 has rotated approximately 90° from its position on the first output conveyor 114.

Figure 14:
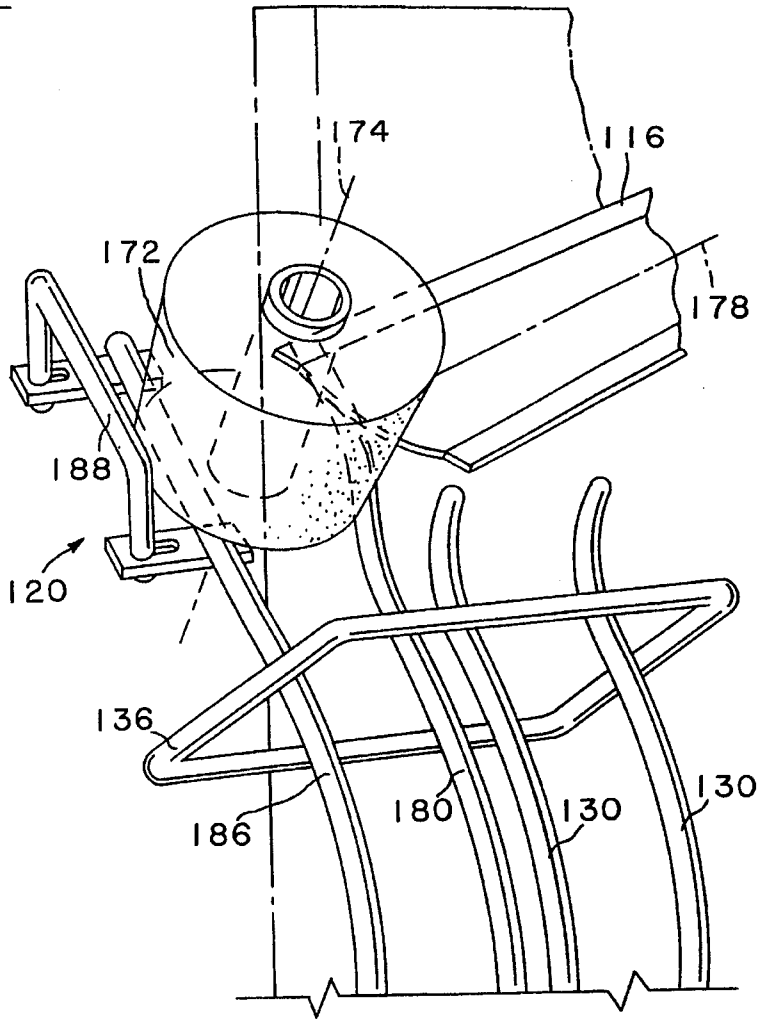
FIG. 14 is a perspective view similar to FIG. 13, except that it shows the package illustrated therein as having just been placed on the second chute of the package transport system.
Figure 13:
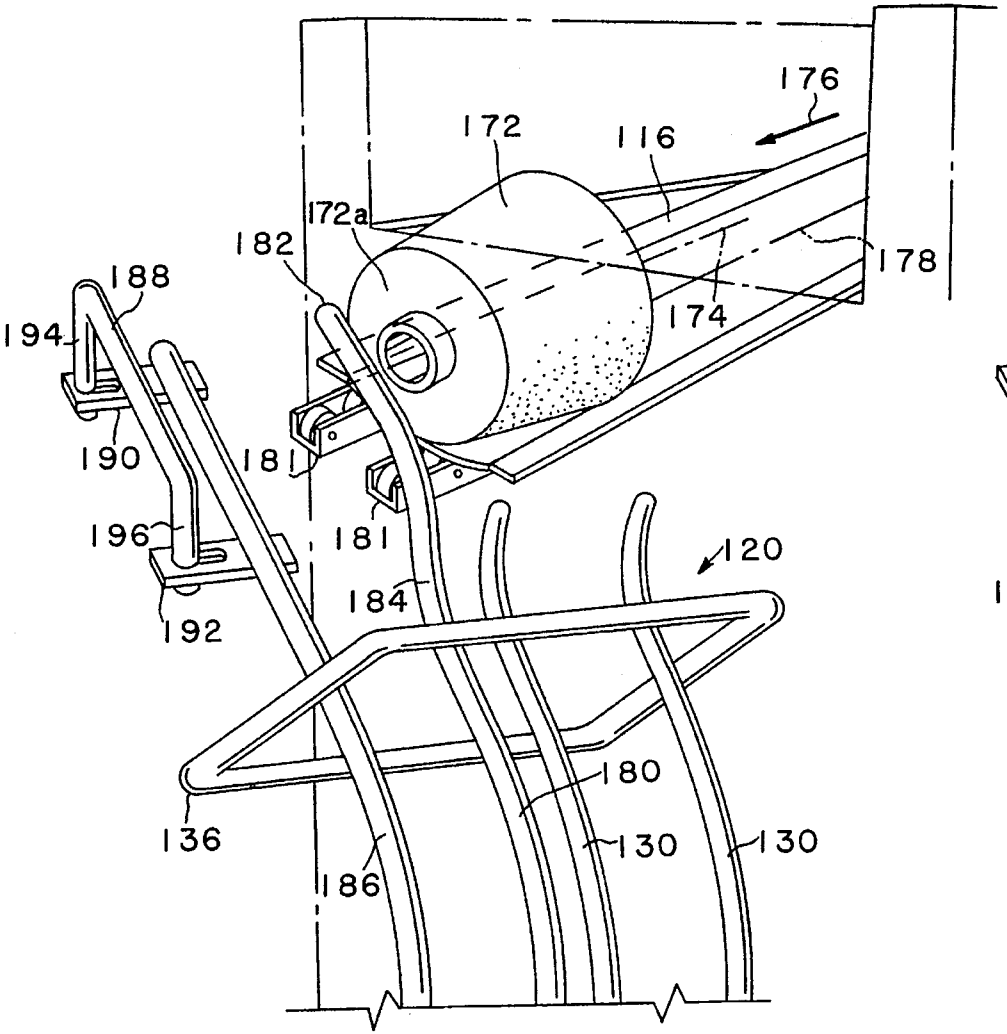
FIG. 13 is a perspective view of a yarn package moving off a second output conveyor of a spinning machine just before it reaches a second chute of the package transport system.

FIGS. 13 and 14 illustrate the cause of a similar change in orientation undergone by a package moving from the second output conveyor 116 onto the second chute 120.

In FIG. 13, a second package 172 having a central longitudinal axis 174 moves toward the end of the second output conveyor 116 in the direction shown by arrow 176. During this motion, axis 174 is substantially parallel to a longitudinal axis 178 of the second output conveyor 116. As front face 172*a* of package 172 passes the end of the second output conveyor 116, the package 172 travels over a pair of roller assemblies 181 hingedly mounted to the second output conveyor 116. Motion in the direction of arrow 176 ceases when front face 172*a* of package 172 contacts a member 180 of rail 132 at a terminal portion 182 of the member 180. In a manner similar to terminal portion 125 of member 124 of the first chute 118, terminal portion 182 may be flared outwardly from the remainder of member 180 through a flared portion 184. Additionally, a member 186 of rail 132 may be provided with a retaining bar 188 disposed alongside it by means of transverse plates 190, 192 providing slotted mountings for the retaining bar 188 in the same manner as described with respect to retaining bar 162, namely, the ends of vertical portions 194, 196 of retaining bar 188 are journaled in slots within the transverse plates 190 and 192.

Referring to FIG. 14, second package 174 has undergone a change in its orientation upon having been transferred to rail 132 of second chute 120. Axis 159 is now substantially perpendicular to the straight portion 155 (FIG. 9) of second chute 120. Second package 174 has therefore rotated approximately 90° from its position on the second output conveyor 116.

Figure 5:
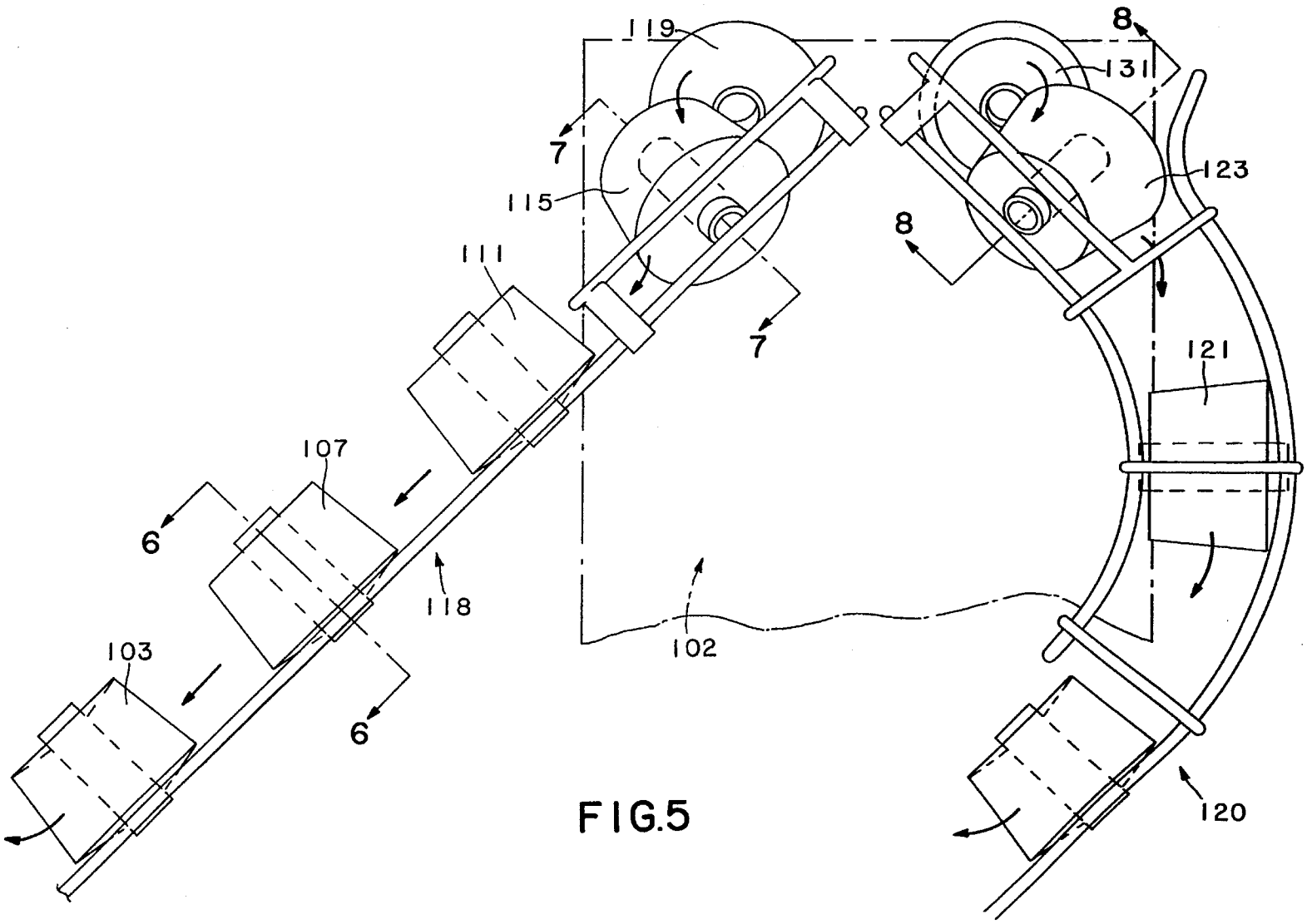
FIG. 5 is a side elevation view of the package transport system illustrated in FIG. 4, showing, among other things, intermediate orientation of yarn packages as they undergo transition from the output conveyors to the chutes.
Figure 8:
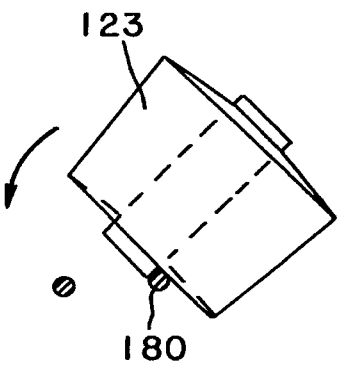
FIG. 8 is a sectional elevation view taken along line 8—8 of FIG. 5.
Figure 7:
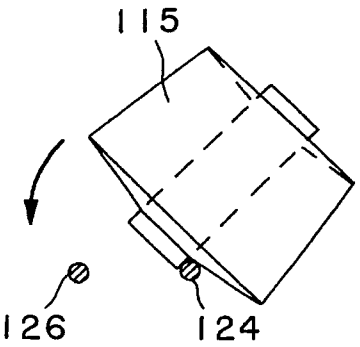
FIG. 7 is a sectional elevation view taken along line 7—7 of FIG. 5.
Figure 6:
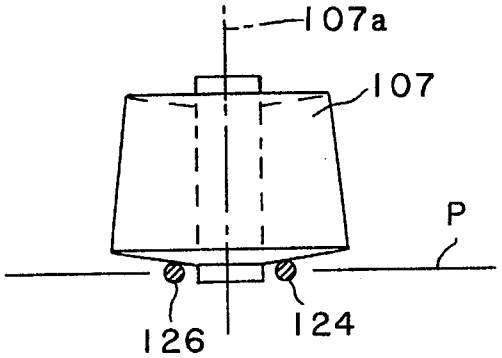
FIG. 6 is a sectional elevation view taken along line 6—6 of FIG. 5.

As second package 172 travels down the second chute 120, axis 174 becomes parallel to the transport conveyor 104 at a point where axis 174 and the profile of retaining ring 138 coincide, since retaining ring 138 lies in a plane which is parallel to the transport conveyor 104 (see, for example, package 121 in FIG. 5).

It is thus seen that a high efficiency production facility constructed in accordance with the present invention includes a system for transporting yarn packages from a textile machine to a transport conveyor which permits the yarn packages to fall by gravity onto the transport conveyor at a uniform distance from one another such that the yarn packages do not make contact.

As the above description is merely exemplary in nature, being merely illustrative of the invention, many variations will become apparent to those of skill in the art. Such variations, however, are included within the spirit and scope of this invention as defined by the following appended claims.

That which is claimed:

1. A facility for producing yarn at a high efficiency, comprising:

a mechanism for randomly mixing fibers;

a first pair of cleaners receiving said fibers from said mechanism, said first pair of cleaners promoting further random mixing of said fibers;

a laydown cross blender receiving said fibers from said first pair of cleaners;

a second pair of cleaners receiving said fibers from said laydown cross blender;

an air fiber separator receiving said fibers from said second pair of cleaners;

a pair of vertical mixers receiving said fibers from said air fiber separator to further mix and randomize said fibers;

a pair of air fiber separators receiving said fibers from said pair of vertical mixers;

a pair of multiple chute feeders receiving said fibers from said pair of air fiber separators, each of said feeders directing portions of said received fibers into a plurality of chutes;

a plurality of carding machines corresponding with and receiving said fibers from respective chutes, each of said carding machines producing carded sliver from said fibers;

coiling means receiving said carded sliver from each of said plurality of carding machines for coiling said carded sliver into a plurality of carding containers; and means for transferring said carded sliver from said plurality of carding containers into a plurality of drawing containers.

2. The facility set forth in claim 1 wherein carded sliver from six of said plurality of carding containers is fed into one of said plurality of drawing containers.

3. The facility set forth in claim 1 further comprising a staging area having controlled temperature and humidity for storing said plurality of drawing containers.

4. The facility set forth in claim 3 further comprising a plurality of spinning machines, each of said machines corresponding to and receiving said carded sliver from a respective drawing can stored in said staging area to produce spun yarn packages.

5. The facility set forth in claim 4 further comprising transporting means for transporting said spun yarn packages from each of said plurality of spinning machines to a transport conveyor.

6. The facility set forth in claim 5 wherein:

each of said plurality of spinning machines has first and second output conveyors, said output conveyors conveying said spun yarn packages from a top portion of each of said plurality of spinning machines;

said transporting means are disposed intermediate said first and second output conveyors and said transport conveyor; and said transport conveyor is supported by a frame.

7. The facility set forth in claim 6 wherein said transporting means comprises:

a first chute communicating with said first output conveyor for transporting a first package from an end of said first output conveyor to said transport conveyor; and a second chute communicating with said second output conveyor for transporting a second package from an end of said second output conveyor to said transport conveyor;

whereby said first and second packages are deposited onto said transport conveyor at a predetermined distance from one another without making contact with one another.

8. The facility set forth in claim 7 wherein said first and second packages respectively travel down said first and second chutes through gravitational force.

9. The facility set forth in claim 7 wherein a profile of said first chute is defined by a first portion inclined at an angle with respect to said transport conveyor, a second portion downstream of said first portion and substantially parallel to said transport conveyor, and an arcuate portion joining said first and second portions.

10. The facility set forth in claim 9 wherein a central longitudinal axis of said first package during transition thereof from said first output conveyor to said first chute changes orientation from a position substantially parallel to said first output conveyor to a position substantially normal to said first portion of said first chum.

11. The facility set forth in claim 7 wherein a profile of said second chute is defined by a first arcuate portion, a second arcuate portion downstream of said first arcuate portion, a first straight portion inclined at an angle with respect to said transport conveyor and joining said first and second arcuate portions, and a second straight portion extending from said second arcuate portion in substantially parallel relation to said transport conveyor.

12. The facility set forth in claim 11 wherein a central longitudinal axis of said second package during transition thereof from said second output conveyor to said second chute changes orientation from a position substantially parallel to said second output conveyor to a position substantially normal to said first straight portion of said second chute.

13. The facility set forth in claim 7 wherein said transporting means further comprises confining means for confining top and bottom faces of said second package along a predetermined length of said second chute.

14. The facility set forth in claim 13 wherein said first chute is constructed of a first rail attached to said end of said first output conveyor and said second chute includes a second rail.

15. The facility set forth in claim 14 wherein said confining means further comprises:

a third rail of a predetermined length attached to said end of said second output conveyor spaced equidistantly from said second rail along said length;

whereby said second package travels on said third rail before traveling on said second rail.

16. The facility set forth in claim 15 wherein said transporting means further comprises a retaining ring interconnecting said third rail and said second rail.

17. The facility set forth in claim 15 wherein a profile of said third rail is defined by a straight portion inclined at an angle with respect to said transport conveyor and an arcuate portion downstream of said straight portion.

18. The facility set forth in claim 17 wherein said straight portion of said third rail is substantially perpendicular to said first portion of said first chum.

19. The facility set forth in claim 7 wherein said transporting means further comprises means for retaining said first and second packages on said transport conveyor once said first and second packages leave said first and second chutes.

20. The facility set forth in claim 19 wherein said means for retaining said first and second packages on said transport conveyor is a retaining rail assembly positioned in operable relation to said transport conveyor.

21. The facility set forth in claim 20 wherein said retaining rail assembly comprises:

a first bracket mounted to said frame;

a second bracket mounted to said frame and longitudinally spaced downstream from said first bracket; and at least one retaining extension connected to said first and second brackets, said retaining extension positioned relative to said transport conveyor so as to restrain said yarn packages from movement which would cause them to fall from said transport conveyor.

22. The facility set forth in claim 7 wherein said transporting means further comprises:

a first wedge-shaped plate mounted to said frame of said of said transport conveyor interconnecting said first chute to said frame; and a second wedge-shaped plate mounted to said frame of said of said transport conveyor interconnecting said second chute to said frame.

23. A method of producing yarn, comprising the steps of:

randomly mixing fibers in a mixing mechanism;

feeding said fibers from said mixing mechanism into a first pair of cleaners;

feeding said fibers from said first pair of cleaners into a laydown cross blender;

feeding said fibers from said laydown cross blender into a second pair of cleaners;

feeding said fibers from said second pair of cleaners into an air fiber separator;

feeding said fibers from said air fiber separator into a pair of vertical mixers;

feeding said fibers from said pair of vertical mixers into a pair of air fiber separators;

feeding said fibers from said pair of air fiber separators into a pair of multiple chute feeders;

directing portions of said fibers in said pair of multiple chute feeders into a plurality of chutes;

feeding said fibers from said chutes into a plurality of carding machines to produce carded sliver from said fibers;

feeding said carded sliver from each of said plurality of carding means into a coiling means;

coiling said carded sliver into a plurality of carding containers; and transferring said carded sliver from said plurality of carding containers into a plurality of drawing containers.

24. The method set forth in claim 23 wherein carded sliver from six of said plurality of carding containers is fed into one of said plurality of drawing containers.

25. The method set forth in claim 23 further comprising the step of storing said plurality of drawing containers in a stage area having controlled temperature and humidity.

26. The method set forth in claim 25 further comprising the steps of:

transferring said carded sliver from said plurality of drawing containers into a plurality of spinning machines, each of said machines corresponding to one of said plurality of drawing containers; and spinning said carded sliver to produce spun yarn packages.

27. The method set forth in claim 26 comprising the further step of transporting said spun yarn packages to a conveyor.

28. The method set forth in claim 27 wherein spun yarn packages from each of said plurality of spinning machines are transported to said conveyor by way of a pair of chutes communicating with said each of said plurality of spinning machines such that said packages are deposited onto said conveyor at a predetermined distance from one another without making contact.

* * * * *